US006546871B1

(12) United States Patent
Glöckner

(10) Patent No.: US 6,546,871 B1
(45) Date of Patent: Apr. 15, 2003

(54) METHOD FOR ADJUSTING A REGISTER

(75) Inventor: Erhard Herbert Glöckner, Eibelstadt (DE)

(73) Assignee: Koenig & Bauer Aktiengesellschaft, Wurzburg (DE)

( * ) Notice: Subject to any disclaimer, the term of this patent is extended or adjusted under 35 U.S.C. 154(b) by 0 days.

(21) Appl. No.: 09/856,163

(22) PCT Filed: Dec. 3, 1999

(86) PCT No.: PCT/DE99/03882

§ 371 (c)(1),
(2), (4) Date: Jun. 4, 2001

(87) PCT Pub. No.: WO00/34042

PCT Pub. Date: Jun. 15, 2000

(30) Foreign Application Priority Data

Dec. 4, 1998 (DE) ..... 198 56 230

(51) Int. Cl.[7] ..... B41L 5/06
(52) U.S. Cl. ..... 101/484
(58) Field of Search ..... 101/228, 483, 101/484, 485, 211, 248

(56) References Cited

U.S. PATENT DOCUMENTS

| | | | | |
|---|---|---|---|---|
| 4,214,524 A | * | 7/1980 | Corse | 101/228 |
| 5,937,756 A | * | 8/1999 | Kishine et al. | 101/228 |
| 6,021,713 A | | 2/2000 | Glockner et al. | 101/211 |

FOREIGN PATENT DOCUMENTS

| | | | |
|---|---|---|---|
| DE | 26 13 600 A1 | 10/1977 | |
| DE | 295 01 373.7 U1 | 6/1995 | |
| EP | 0 914 944 A2 | 5/1999 | |
| JP | 4332846 | 11/1992 | B41F/33/06 |
| JP | 5104701 | 4/1993 | B41F/33/06 |
| WO | WO 98/18626 | 5/1998 | |

* cited by examiner

*Primary Examiner*—Raquel Yvette-Gordon
*Assistant Examiner*—Julian D. Huffman
(74) *Attorney, Agent, or Firm*—Jones, Tullar & Cooper, PC

(57) ABSTRACT

A method for adjusting a color register in a web-fed rotary printing press is accomplished by measuring an actual web tension and comparing it to a reference value for the web tension. If the actual web tension exceeds the reference value by more than a permissible tolerance either the number of revolutions of one of two print positions or the cylinder positions of one of the print positions is changed.

5 Claims, 1 Drawing Sheet

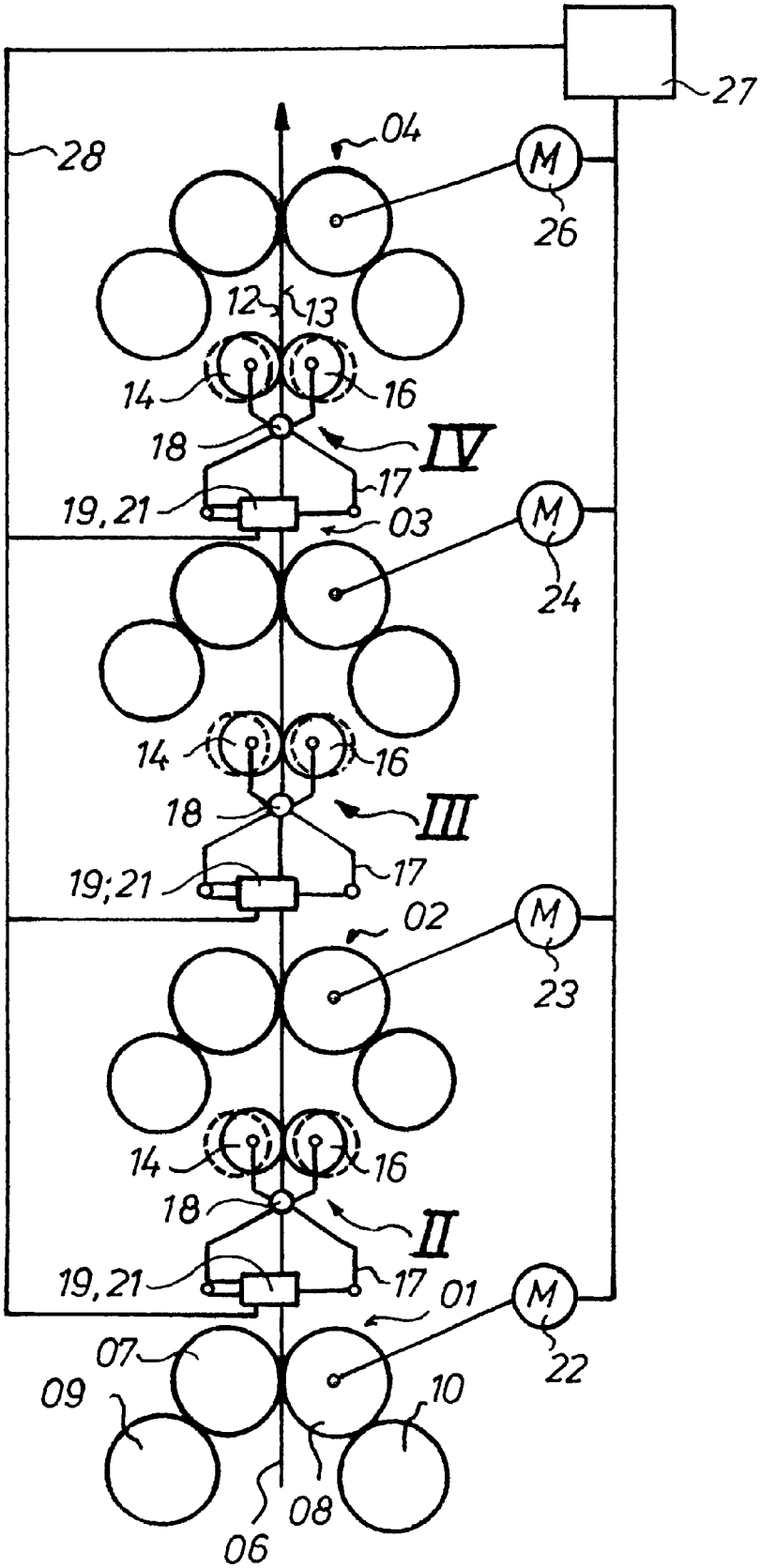
27
28
04
M
26
12
13
14
16
18
IV
17
19, 21
03
M
24
14
16
18
III
19;21
17
02
M
23
14
16
18
II
19, 21
17
01
M
22
07
09
10
08
06

METHOD FOR ADJUSTING A REGISTER

FIELD OF THE INVENTION

The present invention relates to a method for adjusting a register in a web-fed rotary printing press. An actual value of a web tension is determined and is compared to a reference value.

DESCRIPTION OF THE PRIOR ART

A device is known from DE 295 01 373 U1, wherein two image adjustment rollers are arranged between the second and third double printing groups of a rotary printing press having four double printing groups.

The image adjustment rollers are seated, freely rotatable, on pivotable levers. A reading head for scanning register marks, which is connected with an adjusting unit, is arranged downstream of the fourth double printing group. This adjusting unit provides signals by a comparison of a reference with an actual value. An actuating unit is acted upon for putting the image adjustment rollers against something in response to these signals.

DE 26 13 600 A1 discloses a regulation of the number of revolutions of a printing press, wherein guide rollers are regulated as a function of the web tension.

SUMMARY OF THE INVENTION

The object of the present invention is directed to providing a method for adjusting a register.

In accordance with the present invention, this object is attained by determining an actual value of a web tension and comparing it with a reference value. If a deviation between the two exceeds a permissible tolerance, the number of revolutions or the angular position of one of the cylinders is changed.

The advantages which can be realized by means of the present invention reside, in particular, in that available drive motors of the cylinders, or of the printing groups, are used for adjusting the color register. Image-scanning sensors are also not required. The web tension, which is detected by means of simply constructed sensors, is used as the input value for the adjustment.

It is known that noticeable register deviations in the running direction of a web can occur, mainly at roll changes, but also during the running production, which register deviations disappear only after an extended running time, if the register is not adjusted.

The causes of these register deviations are web tension changes in the web as the web passes between the individual printing positions, for example when the web is passing through the device for applying adhesive (2 thicknesses of paper plus the adhesive foil), or when changing the water application.

So-called image track adjusting devices are employed for compensating the fan-out tendencies of the web in eight-element towers.

If now, for example, the small image track adjusting roller in the center of the paper web is prepared, for example by means of wire strain gauges at the support arm in such a way that it can function as a force sensor, the result is a simple possibility for affecting the behavior of the color register of the print unit. It is only necessary to insure that the force on the web at the small image track wheel is maintained constant during production. It is unimportant in this instance how great the force is. It is only necessary to generate a sufficiently large measuring signal, for example 1 to 10 V, or 4 to 20 mA by means of the placement.

The force is maintained constant by the rotation of the respective printing groups. Constant web tension, along with the same wetting, results in the same color register.

Since only the relative deviation of the force is important for the register adjustment, it is possible to employ this type of adjustment with all web tensions sufficient for the production, with all papers used and at all production speeds.

It is only necessary that the printer releases the reference value for the comparing force signal, once its quality stage has been reached, for example by closing the waste shunt.

BRIEF DESCRIPTION OF THE DRAWING

A preferred embodiment of the present invention is represented in the drawings and will be described in greater detail in what follows.

The sole drawing FIG. 1 shows a schematic representation of the print units with devices for correcting the register.

DESCRIPTION OF THE PREFERRED EMBODIMENT

A web-fed rotary printing press has, for example, an eight-element tower in a bridge construction with four print units 01, 02, 03, 04 arranged on top of each other, all as seen in the sole drawing figure. Each of the four print units 01 to 04 is provided with two transfer cylinders, for example rubber blanket cylinders 07, 08, which print on a web of material, for example a paper web 06. A forme cylinder, for example a plate cylinder 09, 10, is assigned to each rubber blanket cylinder 07, 08. The plate cylinders 09, 10 work together with ink and damping agent supply devices, which are not specifically represented. The direction of production of the paper web 06 leads from the bottom print unit 01 in the direction toward the upper print unit 04.

Each of the two rubber blanket cylinders 07, 08 print on the web 06 and thus each forms one print position. Accordingly, a bridge print unit has two print positions, and the eight-element tower of the sole drawing figure has eight print positions.

It is also possible to use print units including a printing group with a printing cylinder. Thus, one print unit can consist of two printing groups, blanket to blanket, or of a printing group with a counter-pressure cylinder.

Upstream of each print unit 02, 03, 04, as viewed in the production direction, and with the exception of the first print unit 01, a positioning unit II, III, or IV with a number of n, or m, positioning elements, or counter-positioning elements, is provided on each side 12, 13 of the paper web 06.

A first positioning unit II, which is located upstream of the print unit 02, in has a number of positioning elements, for example one positioning element 14, on a first side 12 of the paper web 06. A number of counter-positioning elements, for example two counter-positioning elements 16, are arranged on the second side 13 of by the paper web 06. For example, the counter-positioning elements 16 are arranged at a distance a2, wherein a2=half the width of the paper web 06 from each other, and each at a distance a2/2 from a lateral edge of the paper web 06. The positioning element 14 is offset by a distance a2/2 with respect to the two counter-positioning elements 16 so that it is arranged centered in the transverse direction of web 06 between the two counter-positioning elements 16.

All of the positioning elements 14 and all of the counter-positioning elements 16 of each of the three positioning units II to IV can each be structured as positioning rollers and counter-positioning rollers, which rollers are each freely rotatable on a spindle and each of which consists of an ink-repelling material, or is coated with such an ink repelling material.

The displacement of the spindles can be performed in a synchronous manner, for example, by use of two scissors-like displacement devices 17, each of an which consists of two two-armed levers, which two two-armed levers are pivotably connected with each other and whose respective centers of gravity 18 are seated in a lateral frame. A pair of work levers receives the respective ends of the roller support spindles, while a pair of driving levers are each connected with a drive mechanism. The drive mechanism can consist of a pneumatic work cylinder 19. These displacement devices 17 and their work cylinder 19 form a displacement unit.

Each displacement unit has sensors 21 for measuring the force acting on the positioning elements 14 and 16. Thus each sensor 21 is used for measuring the web tension in the paper web 06.

Other generally known devices, for example compensating rollers for measuring a bearing force, can also be provided as the sensor 21 for detecting the web tension in the paper web 06.

The driving of the print units 01 to 04 takes place by the use of respective angular position-regulated motors 22, 23, 24, 26.

It is also possible to assign each cylinder pair, consisting of rubber blanket cylinders 07, 08 and plate cylinders 09, 10, to its own motor, or each cylinder 07 to 10 can be provided with its own motor.

The motors 22, 23, 24, 26 are rpm-controlled and/or angular position-regulated.

For adjusting the register of the print image formed on the paper web 06, an output signal of the respective sensor 21, which detects the web tension, i.e. an actual value of the web tension in the paper web 06, is provided to a computer 27. The computer 27 compares this actual value of the web tension in the paper web 06 with a predetermined reference value stored in the computer 27. When a permissible tolerance is exceeded, the computer 27 emits a signal for changing the number of revolutions and/or angular position of a first print position relative to a second print position. In relation to the production direction, the first and second print positions are arranged behind each other.

The sensors 21, the computer 27 and the motors 22, 23, 24, 26 are connected by means of a bus system 28, for example.

The adjustment of the register can also be activated only part-time, preferably immediately before and after a roller change.

While a method for adjusting a color register in a web-fed rotary printing press in accordance with the present invention has been set forth fully and completely hereinabove, it will be apparent to one of skill in the art that a number of changes in, for example the sizes of the printing groups, the specific type of computer used and the like could be made without departing from the true spirit and scope of the present invention which is accordingly to be limited only by the following claims.

What is claimed is:

1. A method for adjusting a register in a web-fed rotary printing press including:

determining an actual value of a web tension in a web being printed in a web-fed rotary printing press before and after a web roll change;

providing a reference value of a web tension in a web being printed in a web-fed rotary printing press;

providing a permissible tolerance between said actual value and said reference value;

comparing said actual value to said reference value;

determining a deviation between said actual value and said reference value; and changing the register only before and after a web roll change by adjusting at least one of a number of revolutions and an angular position of at least one cylinder of a first print position relative to at least one cylinder of a second print position when said deviation is greater than said permissible tolerance.

2. The method of claim 1 further including providing said first print position and said second print position as bridge printing units.

3. The method of claim 1 further including determining said actual value of a web tension between said first and second print positions.

4. The method of claim 1 further including providing a sensor for determining said actual value of said web tension.

5. The method of claim 4 further providing said sensor as a contact roller of an image track adjusting device.

* * * * *